United States Patent [19]

Heese et al.

[11] 3,949,699

[45] Apr. 13, 1976

[54] METHOD AND APPARATUS FOR CONNECTING A TUG WITH A BARGE

[75] Inventors: William E. Heese, Wadsworth, Ohio; John R. Sutton, Beaumont, Tex.

[73] Assignees: HydraPower Inc., Wadsworth, Ohio; Offshore Equipment Development Co., Beaumont, Tex.

[22] Filed: Nov. 13, 1974

[21] Appl. No.: 523,506

[52] U.S. Cl. ..... 114/235 A

[51] Int. Cl.[2] ..... B63B 21/62

[58] Field of Search..... 114/235 R, 235 A; 280/482, 280/504, 508–510; 172/275; 213/101, 149, 82, 85, 96; 279/2

[56] References Cited

UNITED STATES PATENTS

| | | | |
|---|---|---|---|
| 3,788,259 | 1/1974 | Colin | 280/508 X |
| 3,827,407 | 8/1974 | Stratienko et al. | 114/235 A |
| 3,830,186 | 8/1974 | Janssen et al. | 114/235 A |
| 3,837,316 | 9/1974 | Stratienko et al. | 114/235 A |

FOREIGN PATENTS OR APPLICATIONS

| | | | |
|---|---|---|---|
| 258,865 | 10/1968 | U.S.S.R. | 114/235 A |

*Primary Examiner*—Trygve M. Blix

*Assistant Examiner*—Stuart M. Goldstein

*Attorney, Agent, or Firm*—Burns, Doane, Swecker & Mathis

[57] ABSTRACT

A method of and apparatus for connecting two vessels, such as a tugboat and a barge, to form a composite vessel, are disclosed. The method uses hydraulically powered apparatus completely controlled from one of the vessels to extend a shaft from one vessel toward the other vessel which has apparatus to capture the extended shaft. The method accommodates substantial misalignment between the vessels being connected by permitting lateral adjustment during connection. The apparatus for effecting the connection includes an active member carried by one of the vessels and a passive member carried by the other of the vessels. The active member is hydraulically actuated, includes a longitudinally reciprocable shaft which is actuated by a powered toggle linkage, and includes a release mechanism. The passive member is carried by the other of the vessels and automatically engages the shaft of the active member. The toggle linkage establishes a latching mechanism which does not require separate locking members and which does not fail in the event of pressure loss or hydraulic fluid leakage.

17 Claims, 15 Drawing Figures

METHOD AND APPARATUS FOR CONNECTING A TUG WITH A BARGE

BACKGROUND OF THE INVENTION

1. Field of the Invention

The invention concerns a method and apparatus for connecting two waterborne vessels together to create a composite vessel. More specifically, the invention relates to a method and apparatus for effecting a releasable, self-locking connection between a tugboat and a barge.

2. Description of the Prior Art

In the past it has been known to form a composite, waterborne vessel by connecting a tugboat with a barge. Typically, the barge used in such combinations is provided with a slot in the stern portion thereof which receives the bow of the corresponding tugboat. A mechanical connection between the tugboat and the barge has been generally employed to securely and releasably join the two vessels into the composite structure.

The use of conventional bollards in combination with suitable lines and quick release means to connect a tugboat and a barge is known in the art. Such connecting apparatus, however, is fraught with problems which inhibit its usefulness. For example, the tugboat must be properly aligned with a slot prior to entry thereinto. In addition, the requisite lines are susceptible to failure in rough seas, thus creating a potential for disengagement between the two vessels. Further, a connection system employing cables conventionally requires personnel on both vessels cooperating with one another properly to position and tension the cables.

It is also known to employ hydraulically operated members carried by a tugboat to facilitate the connection of the tugboat to a barge. Such hydraulically operated apparatus, however, is typically provided to wedge the tugboat and barge together thereby retaining the two vessels in their composite relationship even in the face of rough seas. Leakage of hydraulic fluid or loss of hydraulic pressure presents a potentially severe problem in that it may allow loss of latching force between the two vessels. Another common problem with hydraulic wedging apparatus resides in the fact that the vessels must be properly aligned before the hydraulically actuated members can be effective to secure and position the two vessels relative to one another. As with the wedging mechanisms, however, the loss of hydraulic pressure, leakage of hydraulic fluid or misalignment of the vessels may present intolerable problems.

It is also known to employ threaded-type connections between two vessels. Such connections, however, are cumbersome, require previous alignment between the two vessels and do not permit the use of rapidly actuated members.

SUMMARY OF THE INVENTION

Accordingly, it is a general object of this invention to overcome the problems existing in prior art devices such as those noted above.

It is a more specific object of the present invention to provide a novel connecting system which is effective to draw two vessels together into proper relationship to form a composite vessel.

Another object of the present invention is to provide a novel apparatus which mechanically locks itself in a retracted position.

Still another object of the present invention is to provide a novel connecting system which employs hydraulically actuated rotaters to manipulate a longitudinal shaft carried by one vessel and is automatically engaged by a passive target assembly carried by the other vessel.

A still further object of the present invention is to provide a novel connecting system for a boat-barge composite vessel which includes a self-contained independently actuated releasing mechanism operable solely from the vessel carrying the active member.

Yet another object of the present invention is to provide a novel method of connecting a tugboat with a barge by using hydraulically operated apparatus.

Another object of the present invention is to provide a novel method of disconnecting a barge from a tug employing hydraulically actuated apparatus.

Apparatus intended to substantially accomplish the above and many other objects includes a passive member carried by one of the vessels and an active member carried by the other of the vessels. The active member includes a toggle linkage powered by an hydraulic rotater to reciprocate a horizontally disposed shaft. The shaft is projected forwardly from one of the vessels and is provided with a generally annular groove in the projecting end. The shaft is engaged by the passive element upon entering an opening defined between a pair of resiliently mounted jaws. The jaws are cammed outwardly relative to one another by the end of the shaft and subsequently engage and latch in the annular groove provided on the end of the shaft. The shaft is provided with a suitable releasing mechanism which may be actuated from the vessel carrying the active member to engage and spread the jaws of the passive member thus permitting the shaft to be withdrawn from engagement by the passive member.

BRIEF DESCRIPTION OF THE DRAWINGS

One embodiment of the present invention is illustrated in the accompanying drawings in which.

DESCRIPTION OF THE PREFERRED EMBODIMENT

Figure 2:
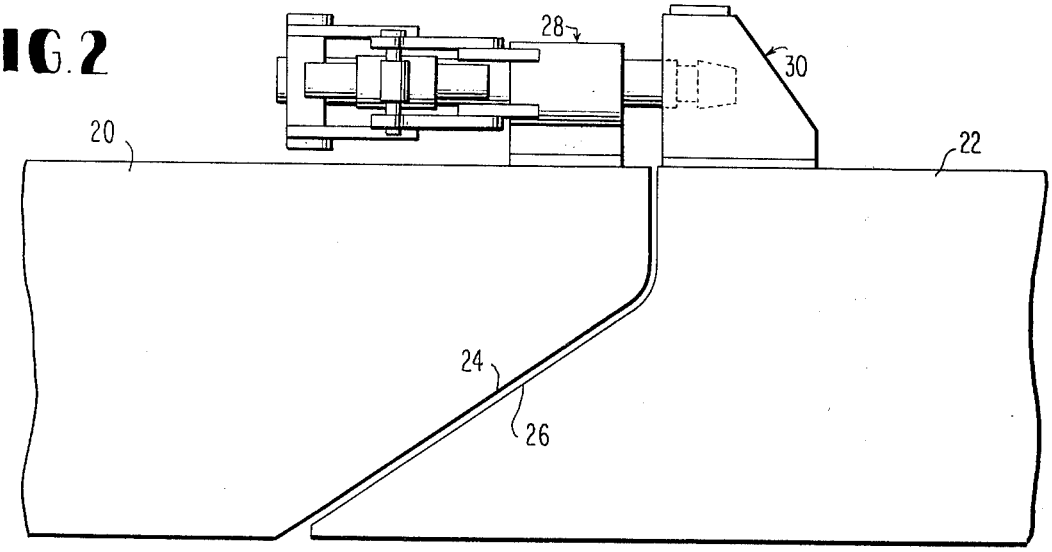
FIG. 2 is a side elevational view of the apparatus of FIG. 1.
Figure 4:
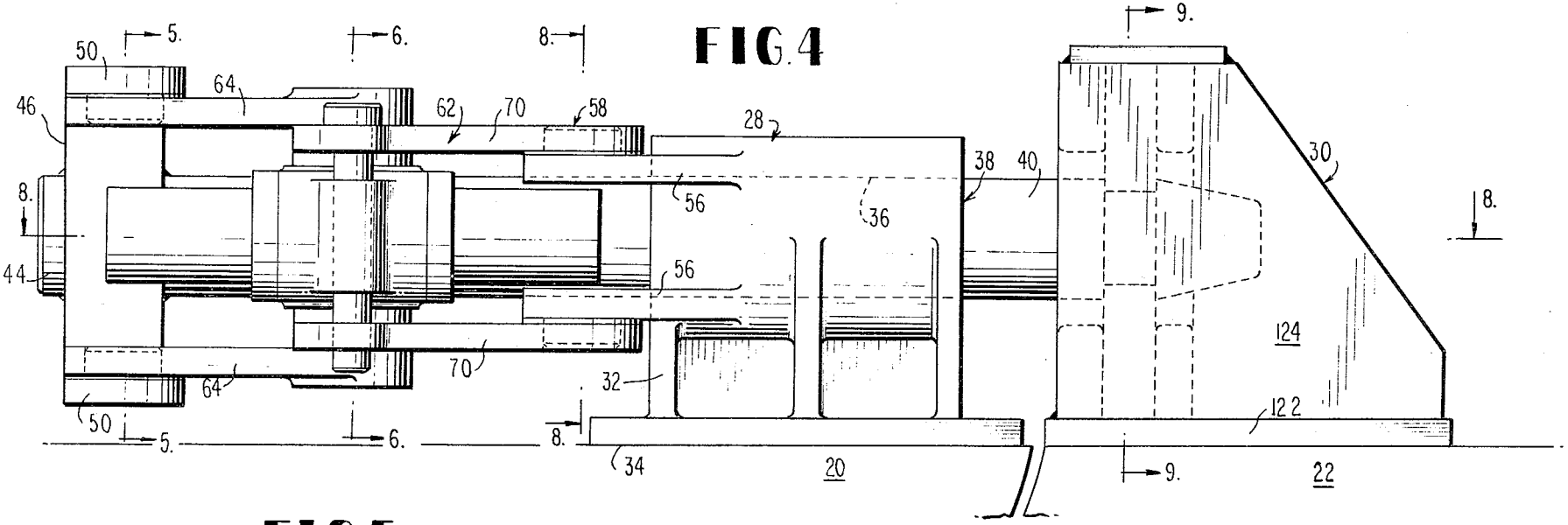
FIG. 4 is an enlarged, side elevational view of the apparatus similar to FIG. 2.

Turning now to FIGS. 2 and 4, a portion of a tugboat 20 is depicted in juxtaposition with respect to a portion of a barge 22 having an opening 26 in the stern portion thereof which receives a bow portion 24 of the tugboat 20. A connecting assembly is provided to interconnect the two vessels in the relationship depicted. The assembly comprises an active member 28 which is carried by the bow portion 24 of the tugboat 20 and a passive member 30 which is carried by the stern of the barge 22. While the active member is illustrated as being carried by the tugboat 20, it would also be possible to provide the active member 28 on the barge 22 and reverse the position of the passive member 30. The preferred configuration would be, however, with the active member 28 carried by the tugboat 20 since the tugboat 20 would be more likely than the barge 22 to have a suitable power source to supply hydraulic fluid for actuation of the active member 28.

Figure 7:
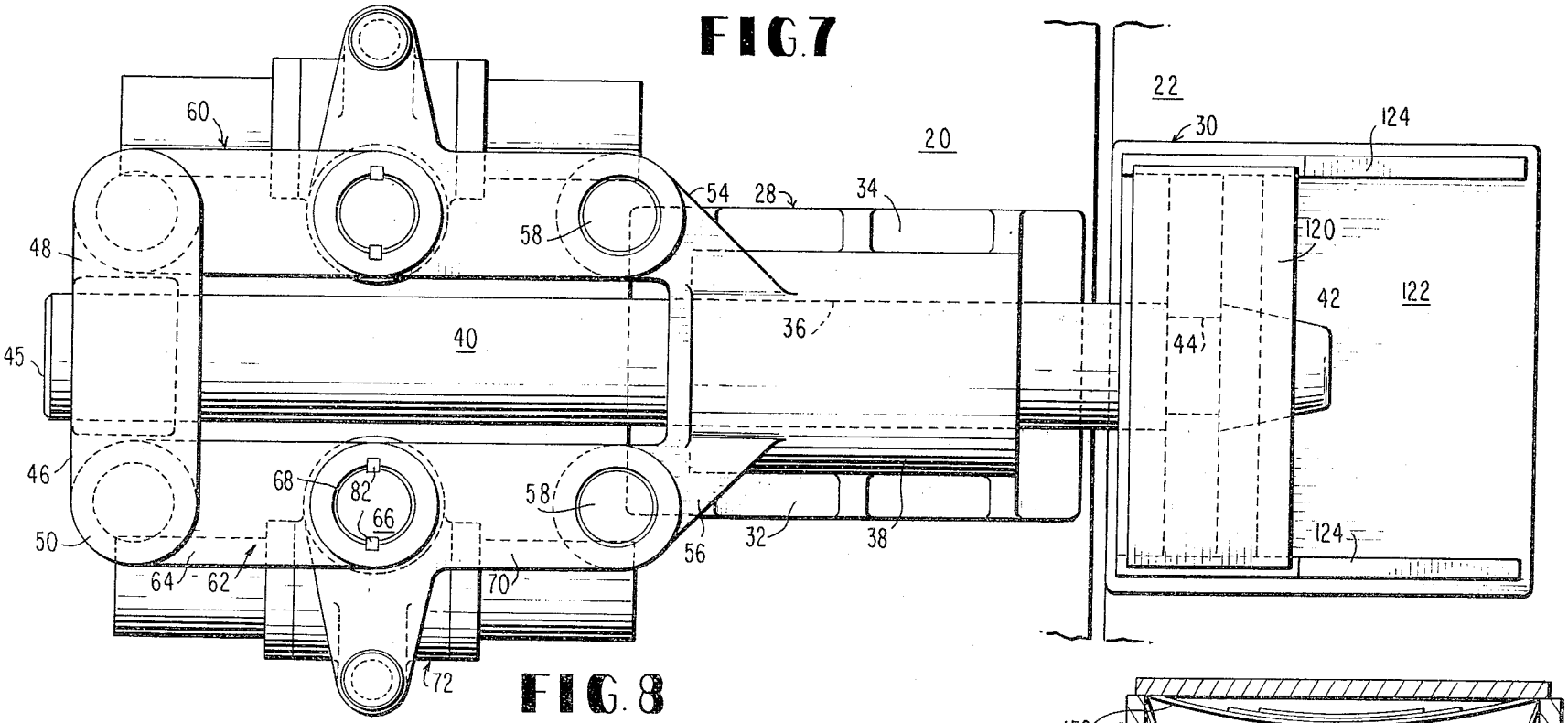
FIG. 7 is a further enlargement of the assembly.

Turning now to FIG. 4 where the coupling system is illustrated in greater detail, the active member 28 includes a base member 32 which has a bottom surface 34 that is adapted to be securely mounted on the tugboat 20. With reference to FIG. 7, it will be apparent that the base 32 is also provided with a generally cylindrical longitudinal bore 36 which is horizontally disposed with respect to the base member 32 and which extends longitudinally through a cylindrical portion 38 of the base member 34.

The longitudinal bore 36 receives a generally cylindrical shaft 40 which is mounted for reciprocating motion with respect to the base member 32. It will thus be appreciated that the cylindrical portion 38 of the base member 34 provides a journal bearing which supports the shaft 40. The shaft 40 is provided with a generally circular cross-sectional configuration. It is, however, quite apparent that other cross-sectional configurations may also be suitable for use in practicing this invention.

The shaft 40 is provided with a frusto-conical end 42 and with a generally annular recess 44. The annular recess is adjacent the frusto-conical portion 42 and in proximity to the end of the shaft 40. The second end 45 of the shaft 40 has a generally I-shaped pintle bar 46 (see FIG. 5) securely connected thereto. The pintle bar 46 may be secured to the shaft 40 by welding or any other suitable means.

Figure 5:
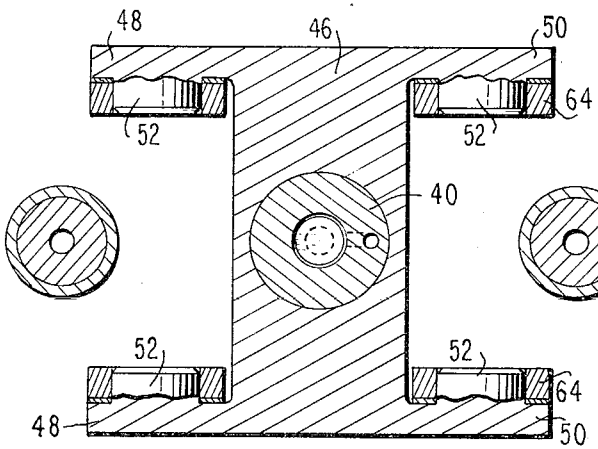
FIG. 5 is a view in partial cross section taken along line 5—5 of FIG. 4.

As most clearly illustrated in FIG. 5, the pintle bar 46 includes two pairs of ears 48, 50, which project laterally from each side of the pintle bar 46. Each ear 48, 50, is provided with a pintle 52.

Figure 8:
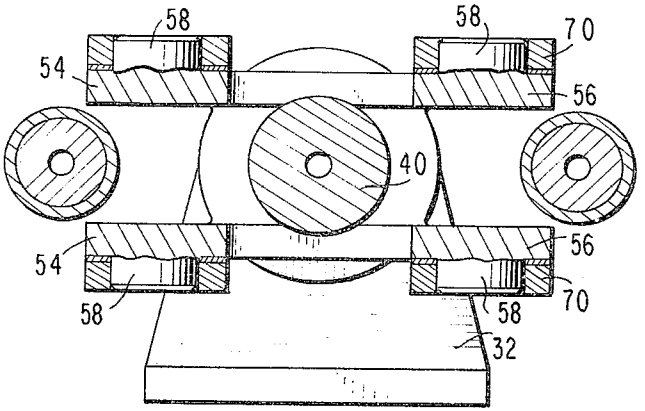
FIG. 8 is a view in partial cross section taken along line 8—8 of FIG. 4.

It will be noted that the base member 32 is also provided with a pair of laterally extending ears 54, 56 (FIG. 7). As shown in FIG. 8, each of the ears 54, 56 projecting from the base member 32 is provided with a pintle 58.

Referring again to FIG. 7, the ears 48 of the pintle bar 46 and the ears 54 of the base member 32 are interconnected by a powered linkage assembly 60. In similar fashion, the ears 46 and the ears 56 are connected by another powered linkage assembly 62 which is laterally disposed on the side of the shaft 40 opposite from the powered linkage assembly 60. Since the powered linkage assemblies 60, 62, are mirror images of one another, it will suffice to describe one of the assemblies in detail, it being understood that the other assembly is comprised of similar members.

The powered linkage assembly 62 may be considered as a toggle linkage that includes a pair of links 64 (see FIG. 4) which are pivotally mounted at one end on the pintles 52 of the ears 50. The other end of each link 64 rotates about a pivot axis 66 (see FIG. 7) and is provided with a generally cylindrical bore 68 which is coaxial with the pivot axis 66. Each powered linkage assembly 62 may also include a pair of bell cranks 70 which comprise a second link that rotates about pivot axis 66. One arm of each bell crank 70 is provided with a bore which is pivotally mounted on pintle 58 of ear 56 projecting from the base member 32. In addition, each powered linkage assembly 62 includes a hydraulic rotator 72.

Figure 6:
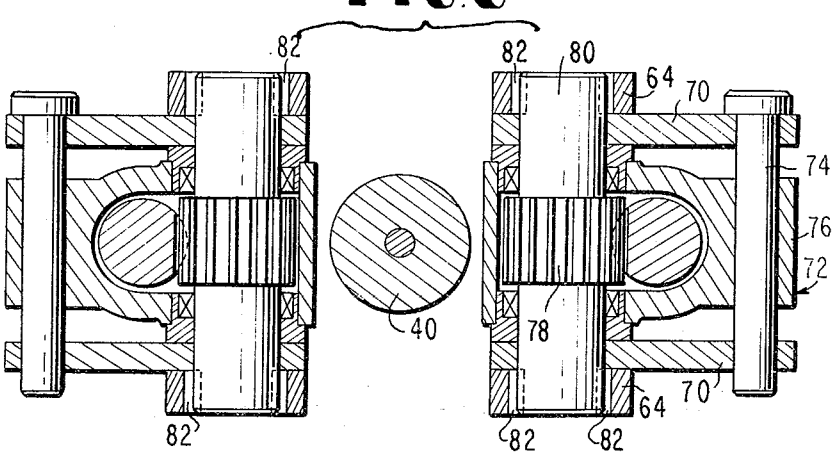
FIG. 6 is a view in partial cross section taken along line 6—6 of FIG. 4.

With reference to FIG. 6, it will be seen that arms of the bell crank 70 are provided with a tie bolt 74 which passes through a housing portion 76 of the hydraulic rotator 72 and to assure that the housing portion 76 will move in conjunction with the bell crank 70. It will also be noted that the rotator 72 includes a pinion gear 78 which is mounted on a generally vertically oriented shaft 80. The axis of shaft is coincidental with the pivot axis 66 of the toggle assembly 62. As will be described, the hydraulic rotator 72 rotates the shaft 80 to articulate the powered linkage assembly 62. Accordingly, the shaft 80 is provided with suitable keys 82 to connect it with the links 64.

Figure 10:
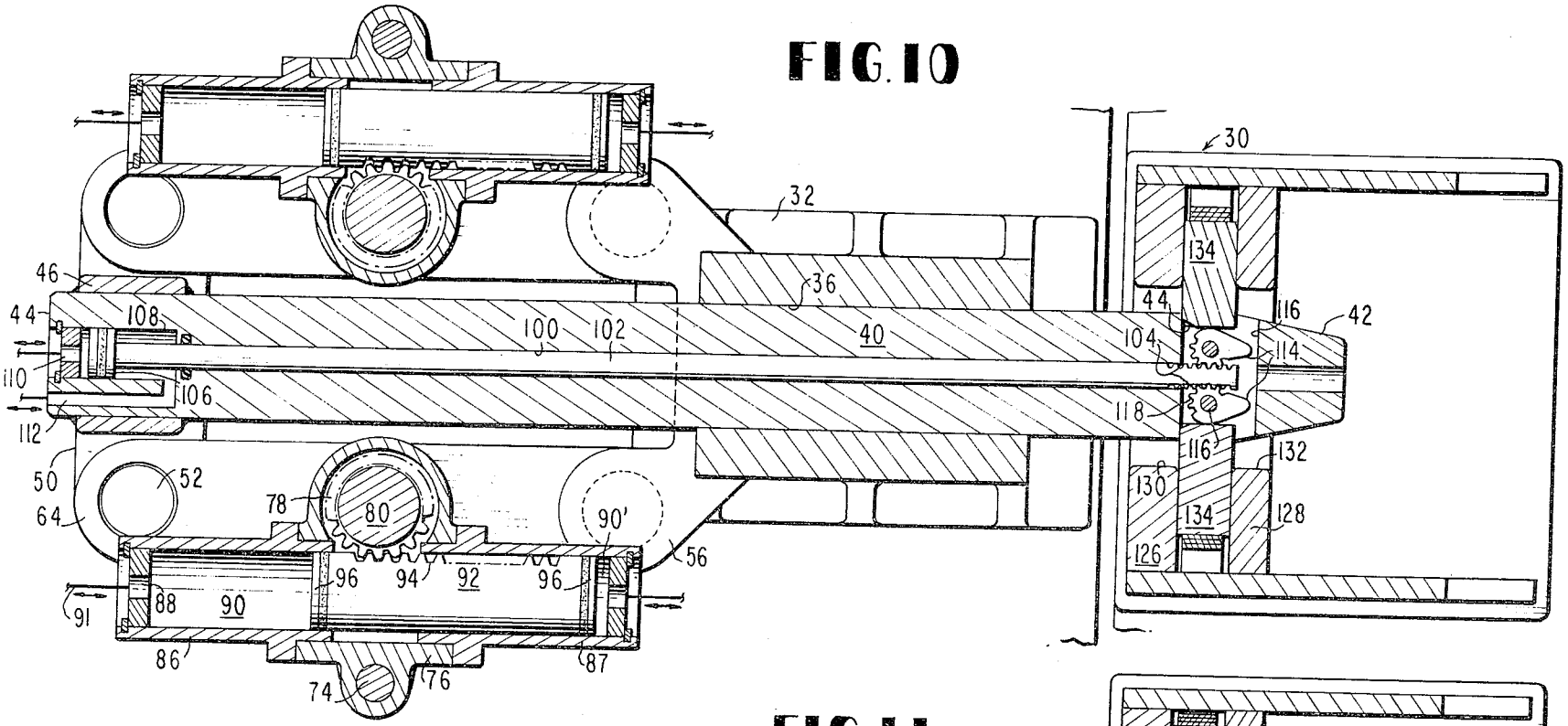
FIG. 10 is a view in partial cross section taken along line 10—10 of FIG. 4.

As most clearly illustrated in FIG. 10, each hydraulic rotator 72 includes a pair of axially spaced coaxial, hydraulic cylinders 86, 87, which are connected to the housing 76 on opposite sides thereof. The end of each cylinder 86, 87, is provided with a suitable port 88 to admit and exhaust hydraulic fluid from a suitable conduit, as schematically illustrated by 91, into a chamber 90, 90′ defined internally of the housing 76 and the cylinders 86, 87, respectively. Disposed internally of the opposed cylinders 86, 87, is a reciprocably mounted piston 92. The piston 92 may be generally cylindrical and is provided with a gear rack 94 in one lateral side thereof. The gear rack 94 meshes with the pinion 78 carried by the vertically disposed shaft 80 so that reciprocation of the piston member 92 imparts rotary motion to the pinion 78. The piston member 92 is also provided with piston faces 96 on each end thereof.

With continued reference to FIG. 10, a disengagement means carried internally of the shaft 40 may be seen easily. The shaft 40 is provided with a coaxial bore 100 running longitudinally therethrough. Disposed within the coaxial bore 100 is an actuator rod 102 having a gear rack 104 at an end of the rod 102 which is disposed internally of the annular recess 44 in the surface of the shaft 40. The other end of the rod 102 is provided with a piston head 106 which is reciprocably mounted within a counterbore 108 of the end 44 of shaft 40. Suitable ports 110, 112 allow hydraulic fluid communication with opposed faces of the piston head 106 to permit the actuator rod 102 to be hydraulically reciprocated.

Figure 9:
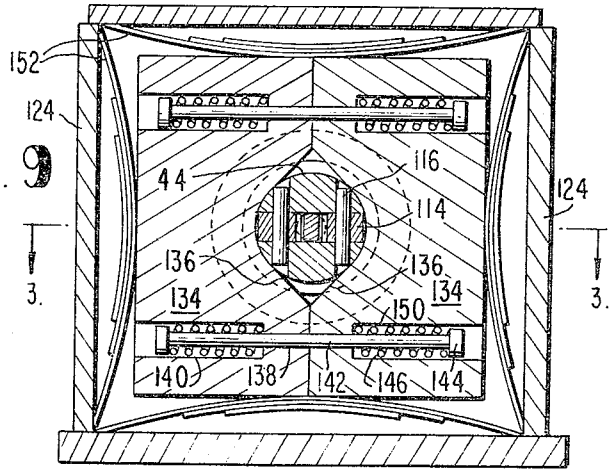
FIG. 9 is a view in partial cross section taken along line 9—9 of FIG. 4.

Near, the frusto-conical end 42 of the shaft 40 and intersecting the annular recess 44, a horizontal slot 116 having a generally rectangular cross section, is provided. The horizontal slot 116 also intersects the coaxial bore 100. A pair of cam members 114 are disposed in the horizontal slot 116 such that one cam member 114 is positioned on each side of the gear rack 104 at the end of the actuator rod 102. Each cam member 114 is pivotally mounted about a shaft 116 and is provided with an arcuate gear surface 118 which meshes with the gear rack 104. As illustrated in FIG. 10, the cam members 114 are in a retracted position. Turning now to FIG. 9, it will be seen clearly that the cam members 114 do not project into the annular recess 44 of the shaft 40 when in the retracted position.

Returning now to FIG. 7, the passive member 30 comprises a vertically upstanding generally rectangular portion 120, a base portion 122 and a pair of vertically upstanding brace members 124 which help support the rectangular portion 120 with respect to the base portion 122. The base portion 122 is mounted on the deck of a barge 22 (see FIG. 4).

Figure 1:
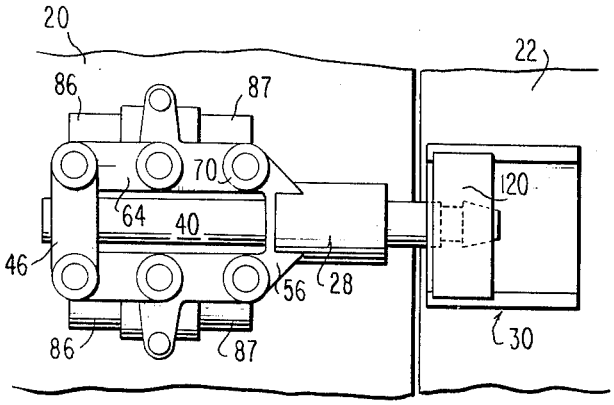
FIG. 1 is a plan view of this embodiment illustrated in a configuration joining a barge and a tugboat.

Turning now to FIGS. 1 and 10, the vertically upstanding portion 120 of the passive member 30 includes a front collar 126 and a rear collar 128, each of which is provided with a central opening 130, 132, respectively, having a diameter substantially greater than the diameter of the shaft 40. Sandwiched between the front and the rear collars 126, 128, are a pair of generally vertical resiliently mounted jaws 134. Each jaw 134 has a generally rectangular configuration (see FIG. 9) and is provided with an arcuate opening 136 on the edge abutting the other jaw such that a generally elliptical opening is defined therebetween to receive the conical end 42 of shaft 40.

Each jaw 134 includes a pair of horizontally extending bores 138 each of which has a counterbore portion 140 open at the edge of the jaw 134 adjacent the bracing member 124 and opposite the abutting edge. The bores 138 of each jaw 134 are in general coaxial alignment with one another and each receives a tie rod 142 having a pair of enlarged ends 144. Each enlarged end 144 is disposed within a counterbore portion 140. Suitable compression springs, such as the helical spring 146, act against each enlarged end 144 of each tie rod 142 and against the bottom 150 of the corresponding counterbore portion 140 to provide a compressive force urging the jaws 134 into an abutting relationship. The jaws 134 are resiliently mounted by providing leaf springs 152 above, below and on each side of the jaws 134 between the front and rear collar members 126, 128.

OPERATION

Figure 12:
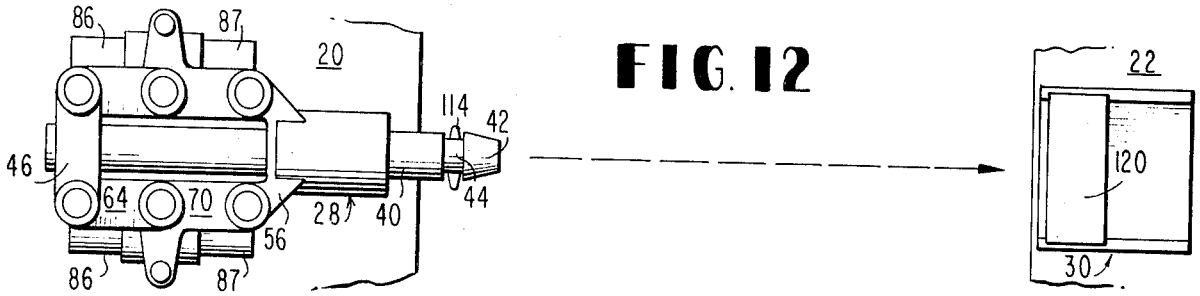
FIG. 12 through 15 illustrate various positions of connecting members during the attachment of a tugboat to a barge.

The operation of the present invention may be best understood by turning to FIG. 12 in which a portion of the tugboat 20 is illustrated in spaced relationship with respect to a portion of the barge 22 to which the tugboat is to be connected. Initially, the tugboat 20 is maneuvered to a position of general alignment between the shaft 40 of the active member 28 and the opening 136 of the passive member 30. The cam members 114 are retracted by pressurizing port 112 (see FIG. 10) at the second end 44 of the shaft 40. The hydraulic cylinders 87 of each hydraulic actuator are then pressurized thereby translating piston member 92 to the left (FIG. 1) and causing articulation between the links 64 and the bell crank 70 (see FIG. 13).

Figure 13:
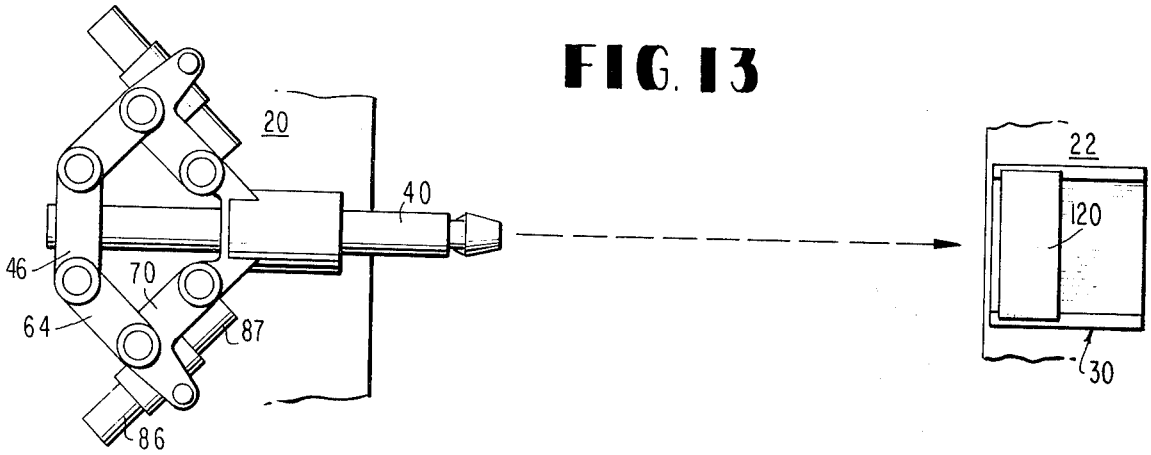
Figure 14:
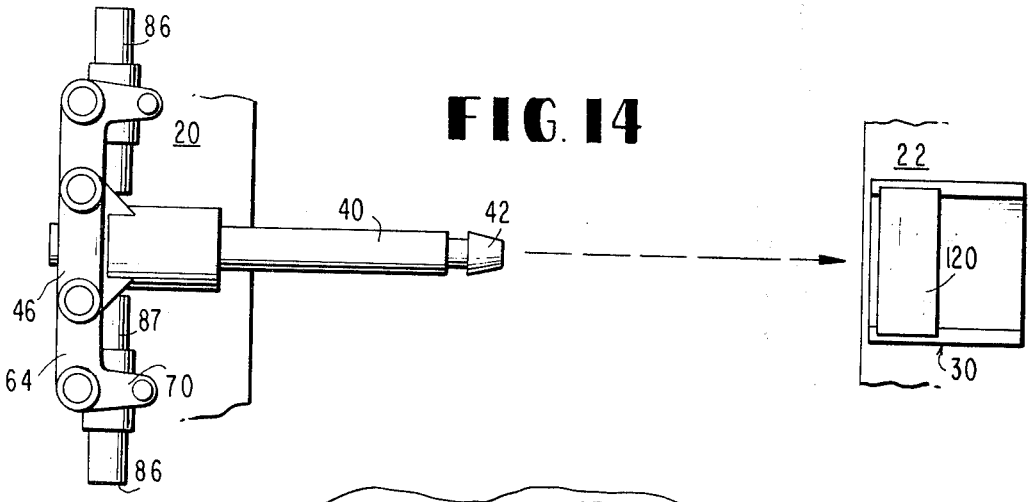

As the cylinders 87 are fully pressurized and the piston member 92 translates, the toggle linkages pass through the configuration illustrated in FIG. 13 and finally assume the configuration depicted in FIG. 14 at which point the bell crank 70 has rotated through an angle of approximately 90° and assumes a position generally perpendicular to the shaft 40.

As the toggle linkage articulates, the pintle bar 46 is drawn forwardly with respect to the tugboat 20 and into superposed relationship with respect to the pintles of the ears 56 projecting from the base member 32. Moreover, the links 64 assume a superposed configuration with respect to the bell cranks 70. Accordingly, the shaft 40 is projected forwardly from the tugboat to the final position illustrated in FIG. 14.

Typically the length of the stroke of ths shaft 40 may be on the order of 6 feet. With the shaft 40 fully extended, the tugboat 20 is moved forwardly toward engagement between the frusto-conical end 42 of the shaft 40 and the passive member 30.

Figure 15:
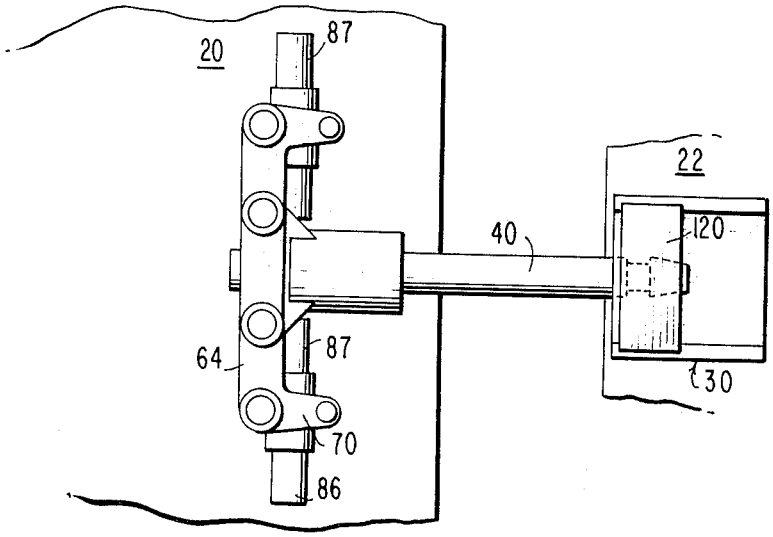

When the frusto-conical end 42 of the shaft 40 enters into the space 136 between the jaws 134 of the vertical portion 120 of the passive member 30, the jaws 134 spread apart until they are aligned with the annular recess 44 of the shaft 40 at which time they resiliently move together and securely grip the end 42 of the shaft 40 (see FIG. 15).

Subsequently, the other pair of hydraulic cylinders 86 of the toggle linkage are pressurized. As the toggle linkage articulates, the shaft 40 is withdrawn into the active member 28 and the barge 22 and the tugboat 20 are drawn together until they assume the configuration depicted in FIGS. 1 and 2.

When the two vessels are connected together as illustrated in FIGS. 1 and 2 it will be apparent that the toggle linkage provides a mechanical lock which securely prevents the vessels from becoming separated even in the event that hydraulic power should be lost or leakage occurs of hydraulic fluid from the hydraulic systems pressurizing the hydraulic actuators.

In order to disconnect the tugboat 20 from the barge 22 utilizing the apparatus of the instant invention, the above procedure is basically reversed. More specifically, the cylinders 87 (see FIGS. 5 and 2) are pressurized, thereby articulating links 64 and bell cranks 70, extending the shaft 40 and pushing the two vessels apart. With the vessels spaced apart as illustrated in FIG. 15, the rotary cams 114 (see FIG. 11) are actuated until they assume a configuration which separates the jaws 134.

The tugboat 20 may then be backed away from the barge 22. The shaft 40 is retracted by pressurizing cylinders 86 until it assumes the configuration illustrated in FIG. 12.

Figure 3:
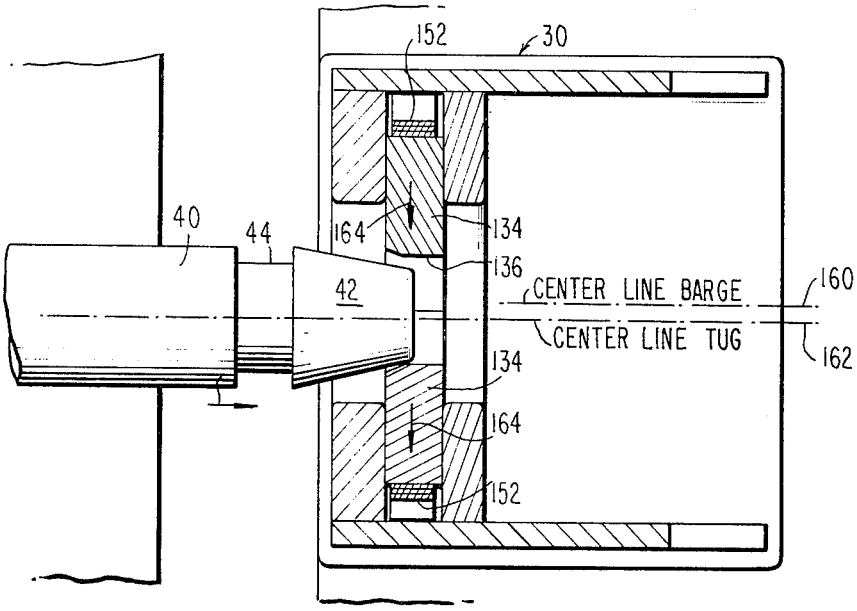
FIG. 3 is an enlarged view in partial cross section showing the shaft and jaw assembly and taken substantially in the line 3—3 in FIG. 9.

The present invention includes means for tolerating misalignment between the shaft 40 and the passive member 30 during engagement therebetween (see FIG. 3). As noted above, the frusto-conical end 42 of the shaft 40 enters the opening 136 between the jaws 134 to effect the connection. In the situation where lateral displacement exists between the centerline of the barge 160 and the extended centerline of the shaft 40, the frusto-conical surface 42 first engages one of the jaws 134 and cams the jaw assembly in the direction illustrated by arrows 164.

At this point it will be apparent that the spring constant of the leaf springs 152 should be lower than the spring constant of the compression springs 146 which resiliently urge the jaws together. By thus defining the relative spring constants, the jaw assembly will be displaced both vertically and horizontally as required to accommodate the misalignment and center the jaw assembly with respect to the frusto-conical end 42 of the shaft 40 as the shaft enters the passive member 30. After the jaw assembly is centered, the jaws 134 will move in laterally opposed directions to accommodate the end 42 of the shaft 40 until the jaws are resiliently urged into engagement with the annular recess 44.

Figure 11:
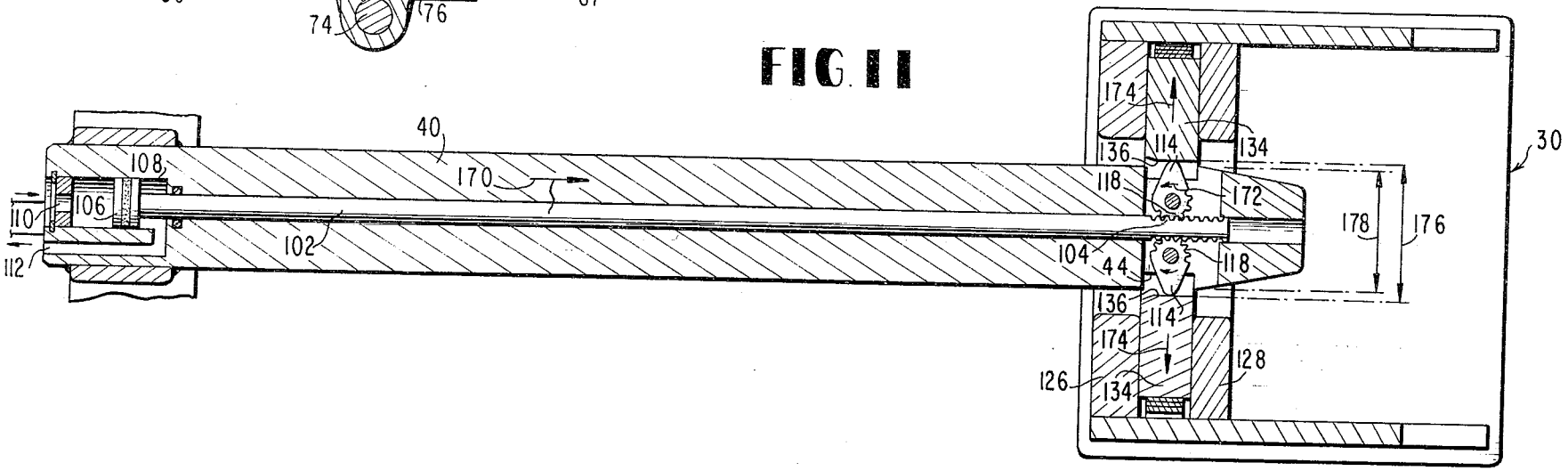
FIG. 11 is a view in partial cross section similar to FIG. 9 and which illustrates the actuation of the jaw release mechanism.

As noted, to disconnect the tugboat 20 from a barge 22, the engagement between the jaws 134 and the shaft 40 must be released. Turning now to FIG. 11, the mechanism whereby the disengagement may be effected is most clearly illustrated. The port 110 is pressurized with hydraulic fluid and the port 112 is simultaneously vented to a suitable reservoir. Accordingly, hydraulic pressure acts on the piston end 106 of the actuating rod 102 and translates the rod 102 in the direction of the arrow 170. The gear rack 104 carried on the second end of the actuating rod 102 cooperates with the arcuate gear surface 118 provided on each of the cam members 114 and rotates each cam member 114 in the direction shown by the arrow 172.

It will be noted that the cam members 114 rotate in opposite directions relative to one another and engage the arcuate opening 136 provided on the abutting edges of the pair of jaws 134. As the cam members 114 rotate to their fully extended position, each jaw 134 is caused to move outwardly with respect to the shaft 40 in the direction shown by the arrow 174. In the outwardmost position the arcuate openings 136 are displaced a 176 which exceeds the diameter 178 of the shaft 40. Accordingly, the jaws 134 are retracted from the generally annular recess 44 and the shaft 140 may be disengaged from the opening between the jaws 134 by backing away from the barge 22.

Thus it is apparent that there has been provided in accordance with this invention a connecting system that substantially satisfies the objects and advantages set forth above.

Although the present invention has been described in conjunction with a specific embodiment thereof, it is evident that many alternatives, modifications, variations and equivalents will be apparent to those skilled in the art in light of the foregoing disclosure and the appended claims. Accordingly, it is expressly intended that all such alternatives, modifications, variations, and equivalents which fall within the spirit and scope of the invention as defined in the appended claims are embraced thereby.

What is claimed is:

1. A method for connecting a first vessel with a second vessel for operation as a composite vessel comprising:

orienting one vessel with respect to a second vessel such that there is general alignment between an active coupling member carried by the first vessel and a passive coupling member carried by the second vessel;

pivotally swinging one link relative to a second link of the active coupling member thereby further extending a shaft of the active coupling member outwardly from the first vessel;

inserting the extended end of the shaft into an opening of the passive member;

automatically capturing the end of the extended shaft with resiliently mounted jaws of the passive member; and retracting the shaft toward the first vessel thereby drawing the first vessel and the second vessel together to form a composite vessel.

2. The connecting method of claim 1 including:

providing an annular groove adjacent the end of the shaft;

resiliently mounting a pair of jaws in the passive member to accommodate vertical and horizontal misalignment between the shaft and the passive member; and capturing the end of the shaft by gripping the annular groove with the jaws.

3. The connecting method of claim 1 including:

providing each side of the active member with a first and second link to extend and retract the shaft relative to the active coupling member; and hydraulically actuating the pivoted first and second links.

4. The connecting method of claim 3 including:

articulating the first and second links by an hydraulically operated rotator.

5. A method of disconnecting a first vessel from a second vessel of a composite vessel comprising:

hydraulically extending a shaft of an active member carried by the first vessel to increase the distance between the first vessel and a second vessel which carries a passive member that laterally engages the end of the shaft;

hydraulically actuating from the first vessel a cam carried by the end of the shaft to disengage the end of the shaft by laterally opening the passive member; and retracting the shaft toward the first vessel to effect complete disconnection of the first vessel and the second vessel.

6. An active member of a coupling system used to connect a first vessel with a second vessel to form a composite vessel, the active member comprising:

a base having a generally horizontal bore extending therethrough and a bottom that is suitable for mounting on the deck of a waterborne vessel;

a shaft having a first end, a second end, a cross-sectional shape conforming with the cross-sectional shape of said bore and being reciprocably mounted within said bore; and a powered linkage means having a first link connected to said base and a second link pivotally connected to said first link and the shaft, said linkage means being operable to reciprocate said shaft relative to said base.

7. An active member of a coupling system used to connect a first vessel with a second vessel to form a composite vessel, the active member comprising:

a base having a generally horizontal bore extending therethrough and a bottom that is suitable for mounting on the deck of a waterborne vessel;

shaft having a first end, a second end, a cross-sectional shape conforming with the cross-sectional shape of said bore and being reciprocably mounted within said bore;

a powered linkage means connected to said base and to said first end of said shaft and being operable to reciprocate said shaft relative to said base; and an hydraulic actuator which converts linear motion to rotary motion, said actuator connecting a first link of said linkage with a second link of said linkage and being operable to articulate said linkage.

8. An active member of a coupling system used to connect a first vessel with a second vessel to form a composite vessel, the active member comprising:

a base having a generally horizontal bore extending therethrough and a bottom that is suitable for mounting on the deck of a waterborne vessel;

a shaft having a first end, a second end, a cross-sectional shape conforming with the cross-sectional shape of said bore and being reciprocably mounted within said bore;

a powered linkage means connected to said base and to said first end of said shaft and being operable to reciprocate said shaft relative to said base;

an hydraulic actuator which converts linear motion to rotary motion, said actuator connecting a first link of said linkage with a second link of said linkage and being operable to articulate said linkage;

a cylinider housing having suitable ports at each end for the ingress and egress of hydraulic fluid and being connected to said first link;

a piston member having a length less than the length of said cylinder housing, two piston ends, and a gear rack on a lateral surface and being mounted within said cylinider housing for reciprocating movement; and a pinion having teeth in meshed engagement with said gear rack and being operably connected to said second link, whereby pressurized hydraulic fluid acting on one piston end of said piston member translates the gear rack thus rotating said pinion and articulating said linkage.

9. The active member of claim 6 including:

disengagement means carried by said second end of said shaft and being operable to effect a release of said second end from a passive latching member carried by another waterborne vessel.

10. An active member of a coupling system used to connect a first vessel with a second vessel to form a composite vessel, the active member comprising:

a base having a generally horizontal bore extending therethrough and a bottom that is suitable for mounting on the deck of a waterborne vessel;

a shaft having a first end, a second end, a cross-sectional shape conforming with the cross-sectional shape of said bore and being reciprocably mounted within said bore;

a powered linkage means connected to said base and to said first end of said shaft and being operable to reciprocate said shaft relative to said base;

a disengagement means carried by said second end of said shaft and being operable to effect a release of said second end from a passive latching member carried by another waterborne vessel;

said disengagement means includes cam means having an arcuate gear surface and being rotatably mounted at said second end of said shaft; and an actuating rod having a gear rack at one end which engages said arcuate gear surface, a piston at the other end and being reciprocably mounted within said shaft.

11. A passive member of a coupling system used to connect a first vessel with a second vessel to form a composite vessel, the passive member comprising:

frame means having a vertically upstanding rectangular portion and a pair of bracing walls;

a pair of vertically upstanding jaw means defining a generally circular opening therebetween and being resiliently mounted within said upstanding rectangular portion for vertical and horizontal movement relative thereto; and guide means carried by said pair of jaw means being operable to accommodate separating movement between said jaw means relative to the opening and to resiliently urge said jaw means toward an abutting relationship.

12. A passive member of a coupling system used to connect a first vessel with a second vessel to form a composite vessel, the passive member comprising:

frame means having a vertically upstanding rectangular portion and a pair of bracing walls;

a pair of vertically upstanding jaws defining a generally circular opening therebetween and being resiliently mounted within said upstanding rectangular portion;

guide means carried by said pair of jaws being operable to accommodate separating movement between said jaws and to resiliently urge said jaws toward an abutting relationship; and said guide means including a horizontal rod having enlarged ends and being recieved by a pair of aligned bores provided in abutting faces of said pair of jaws;

each bore having a counterbore communicating with a non-abutting face of the corresponding jaw;

each enlarged end of said rod being received in one said counterbore; and a compression spring positioned within each said counterbore of said pair of jaws between said enlarged end and the bottom of the said counterbore;

whereby displacement of said jaws is guided by said rod and is resiliently resisted by said springs.

13. The member of claim 12 wherein a plurality of leaf springs are disposed between said jaws and said rectangular portion to accommodate both vertical and horizontal movement of said pair of jaws relative to said frame means.

14. A coupling system used in connecting two waterborne vessels to obtain a composite vessel comprising:

an active member carried by one waterborne vessel and including:

base means;

a horizontal shaft having an annular groove in one end and being reciprocably mounted in said base means;

a powered linkage means having a first link connected to said base means and a second link pivotally connected to said first link and to the other end of said shaft and said linkage means being operable to reciprocate said shaft; and disengagement means disposed within said groove and being operable from said active member; and a passive member carried by another waterborne vessel and including:

frame means;

latching means mounted in said frame means, having an opening therein for receiving said grooved end of said shaft, and being operable to automatically grip and retain said grooved end of said shaft.

15. A coupling system used in connecting two waterborne vessels to obtain a composite vessel comprising:

an active member carried by one waterborne vessel and including:

base means;

a horizontal shaft having an annular groove in one end and being reciprocably mounted in said base means;

a powered linkage means connected to said base means and to the other end of said shaft and being operable to reciprocate said shaft;

disengagement means disposed within said groove and being operable from said active member;

a passive member carried by another waterborne vessel and including:

frame means;

latching means mounted in said frame means, having an opening therein for receiving said grooved end of said shaft, and being operable to automatically grip and retain said groove end of said shaft; and wherein said powered linkage means includes:

a pair of powered toggle linkage assemblies each assembly connected to said base means and to said other end of said shaft;

a pair of hydraulic rotators, one rotator being provided for each said toggle link assembly and being operable to articulate said toggle link assembly.

16. The system of claim 14 wherein said latching means includes a pair of vertically disposed jaws which are resiliently mounted in said frame means.

17. A coupling system for connecting a tugboat to a barge comprising:

a base having a generally horizontal cylindrical bore extending therethrough and a surface suitable for mounting said base on a tugboat;

a cylindrical shaft having a frustoconical end, an annular recess adjacent said frustoconical end, a coaxial bore, a second end, and being disposed within said cylindrical bore;

a pair of toggle linkage assemblies laterally disposed on opposite sides of said shaft, each assembly having a pivot axis and being operably connected to both said base and said second end of said shaft;

an hydraulically actuated rotator disposed at said pivot axis of each said toggle linkage assembly and being operable to articulate said assembly and thereby reciprocate said shaft;

a frame having a vertical rectangular portion and a surface suitable for mounting said frame on a barge;

a pair of jaws having a generally circular opening therebetween, being resiliently mounted in said rectangular portion to allow relative movement between said jaws and said rectangular portion, being resiliently biased into abutment with one another, and being operable to engage said annular recess of said shaft when said shaft projects through said opening; and disengagement means for disengaging said jaws from said annular recess being operable through said coaxial bore of said shaft.

* * * * *